US006065999A

United States Patent [19]

Radliff

[11] Patent Number: 6,065,999

[45] Date of Patent: May 23, 2000

[54] SECONDARY LOCKING SHROUD FOR AN ELECTRICAL CONNECTOR

[75] Inventor: David Ray Radliff, Harrisburg, Pa.

[73] Assignee: The Whitaker Corporation, Wilmington, Del.

[21] Appl. No.: 09/141,116

[22] Filed: Aug. 27, 1998

Related U.S. Application Data

[60] Provisional application No. 60/060,429, Sep. 30, 1997.

[51] Int. Cl.[7] ..... H01R 13/40

[52] U.S. Cl. ..... 439/595

[58] Field of Search ..... 439/274, 314, 439/447, 471, 589, 680

[56] References Cited

U.S. PATENT DOCUMENTS

| | | | |
|---|---|---|---|
| 3,601,760 | 8/1971 | Cairns . | |
| 3,818,420 | 6/1974 | Barr . | |
| 4,477,022 | 10/1984 | Shuey et al. | 439/279 |
| 4,557,542 | 12/1985 | Coller et al. . | |
| 4,595,251 | 6/1986 | Moulin | 439/274 |
| 4,684,187 | 8/1987 | Rudy, Jr. et al. | 439/600 |
| 4,714,437 | 12/1987 | Dyki | 439/595 |
| 4,787,864 | 11/1988 | Hunt, III et al. | 439/595 |
| 5,252,088 | 10/1993 | Morello et al. | 439/271 |
| 5,350,313 | 9/1994 | Woller | 439/157 |
| 5,863,221 | 1/1999 | Castaldo | 439/589 |

*Primary Examiner*—Khiem Nguyen
*Assistant Examiner*—J. F. Duverne

[57] ABSTRACT

The present invention provides a pair of keyed secondary lock members (30,50) which are insertable into respective plug and receptacle housings (22,42). Each secondary lock member (30,50) features a plurality of locking projections (31) extending into the respective housing (22,42) for engaging terminal locking fingers (55). Latches (34,52) are provided for securing the secondary lock members (30,50) in both a pre-latched and a locked position. Each secondary lock member (30,50) also features a terminal shroud area (33,51) which are keyed to each other and provide shock protection when the connectors are in an unmated condition.

3 Claims, 5 Drawing Sheets

SECONDARY LOCKING SHROUD FOR AN ELECTRICAL CONNECTOR

This application claims benefit of provisional application 60/060,429 filed Sep. 30, 1997.

FIELD OF THE INVENTION

This invention is related to electrical connectors and more particularly secondary locking contact shroud for use in such connectors.

BACKGROUND OF THE INVENTION

Electrical connectors having secondary lock members are well known in the art. These connectors provide a secondary locking member for cooperating with a latch to assure that contacts are properly secured. The secondary lock member typically is wedged between the latch and some backup surface inside the housing to ensure that the latch remains seated in the contact when a pulling force is applied.

An example of such a connector is shown in U.S. Pat. No. 4,740,437 by Dyki. This patent shows a separable electrical connector for a plurality of axially connectable cylindrical electrical terminals adapted for coupling to the threads of insulated wires and having an annular external recess on each of the terminals. The connector includes a tubular housing having a plurality of apertures extending axially therethrough and a plurality of outboard ramping retention abutments formed integrally with the housing upon at least one inner surface of a radially outboard portion of the housing. A plurality of axially extending terminal guide fingers is included upon a central land located within the housing. A spacer engages the central land for displacing the terminal guide fingers in the direction of the ramping retention abutments so that the terminals will be retained securely within the connector housing.

Another example of such a secondary locking device is shown in U.S. Pat. No. 3,601,410 by Cairns. This patent teaches an electrical connector including both a terminal having an annular recess and a housing having an aperture therein for receiving the terminal. A flexible wall forms a portion of the housing and this wall extends along and defines at least a portion of the length of the housing's terminal receiving aperture. A locating tab secured to the flexible wall enters the annular recess of the terminal to position it within the receiving aperture. A locking device is attached to the housing to prevent the free flexing of the flexible wall when the tab has positioned the terminal within the aperture.

In both of these patents, it should be noted that the terminals are completely surrounded by insulative housing material to avoid the risk of electrical shock to a user when the connectors are in an unmated condition. In a connector with a relatively small number of terminals, for example, two rows of two or three terminals, forming the housing to have insulative walls that extend around each contact and between each contact is a relatively common practice. However, in applications where it is desirable to achieve higher terminal densities, for example more than two rows of terminals within a relatively small housing, a problem exists in that forming the housing to insulate each terminal will unduly increase the size of the housing.

An additional problem exists with the connectors shown in these patents when it is desirable to achieve higher terminal densities by adding rows. For example, in both of these patents, it can be seen that a secondary locking member is positioned between two rows of adjacent terminals. In the event that it is desirable to achieve more than two rows of terminals, additional secondary locking devices would be required for the additional rows thus creating the need for additional space adjacent to each row to receive the secondary locking devices. This will also increase the overall size of the connector housing.

In addition to these problems, in applications where many plugs and receptacles are present it is desirable to prevent mating of a plug with the wrong receptacle.

SUMMARY OF THE INVENTION

It is therefore an object of this invention to provide a secondary locking arrangement for use in a high density electrical connector which offers a shock protection feature.

It is an additional object of the invention to provide a means to ensure that a plug is matable only with the correct complementary receptacle.

An electrical connector has a plurality of contact receiving passageways disposed inside a housing, with contacts in the passageways. A plurality of projections extend forwardly at the mating face along and around the contacts and beyond the leading ends of the contacts, while the mating connector housing includes recesses complementary to the projections that extend into the mating face of the mating connector such that its contacts are recessed from the mating face; both connectors thus have contact shrouds.

Preferably, a contact-locking latch arm of the housing extends from a wall of each contact receiving passageway, and a secondary lock member is used with the housing and has projections profiled to fit between each latch arm and a respective wall of a contact receiving passageway, to secure the latch arms in the locked position. The contact shroud may also be formed integrally with the secondary lock member, by the plurality of projections being profiled to substantially surround each of the contacts.

BRIEF DESCRIPTION OF THE DRAWINGS

The invention will now be described by way of example with reference to the accompanying drawings, in which.

DETAILED DESCRIPTION OF THE EMBODIMENT

Figure 1:
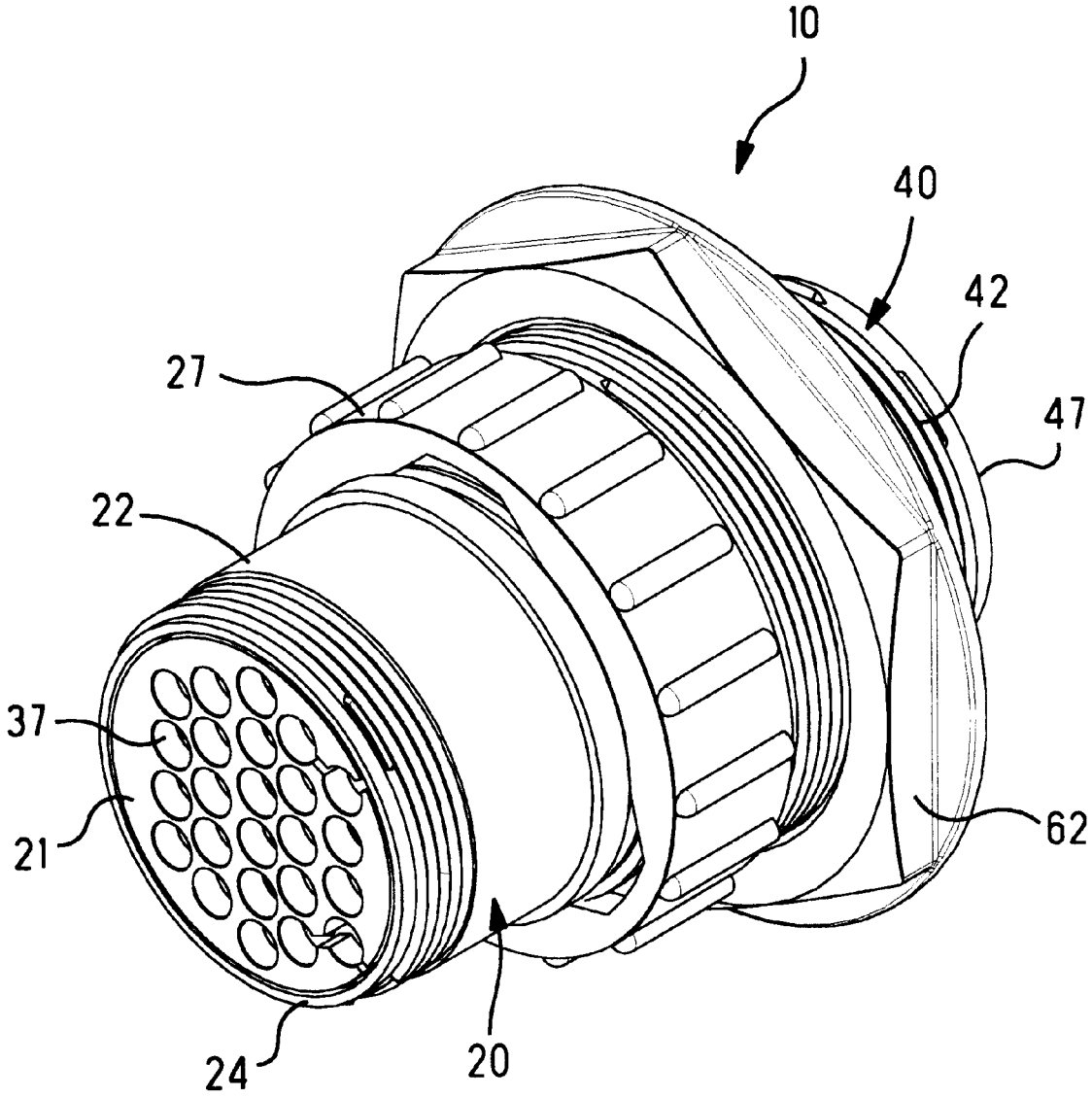
FIG. 1 shows an isometric view of the electrical connector system according to the present invention.
Figure 2:
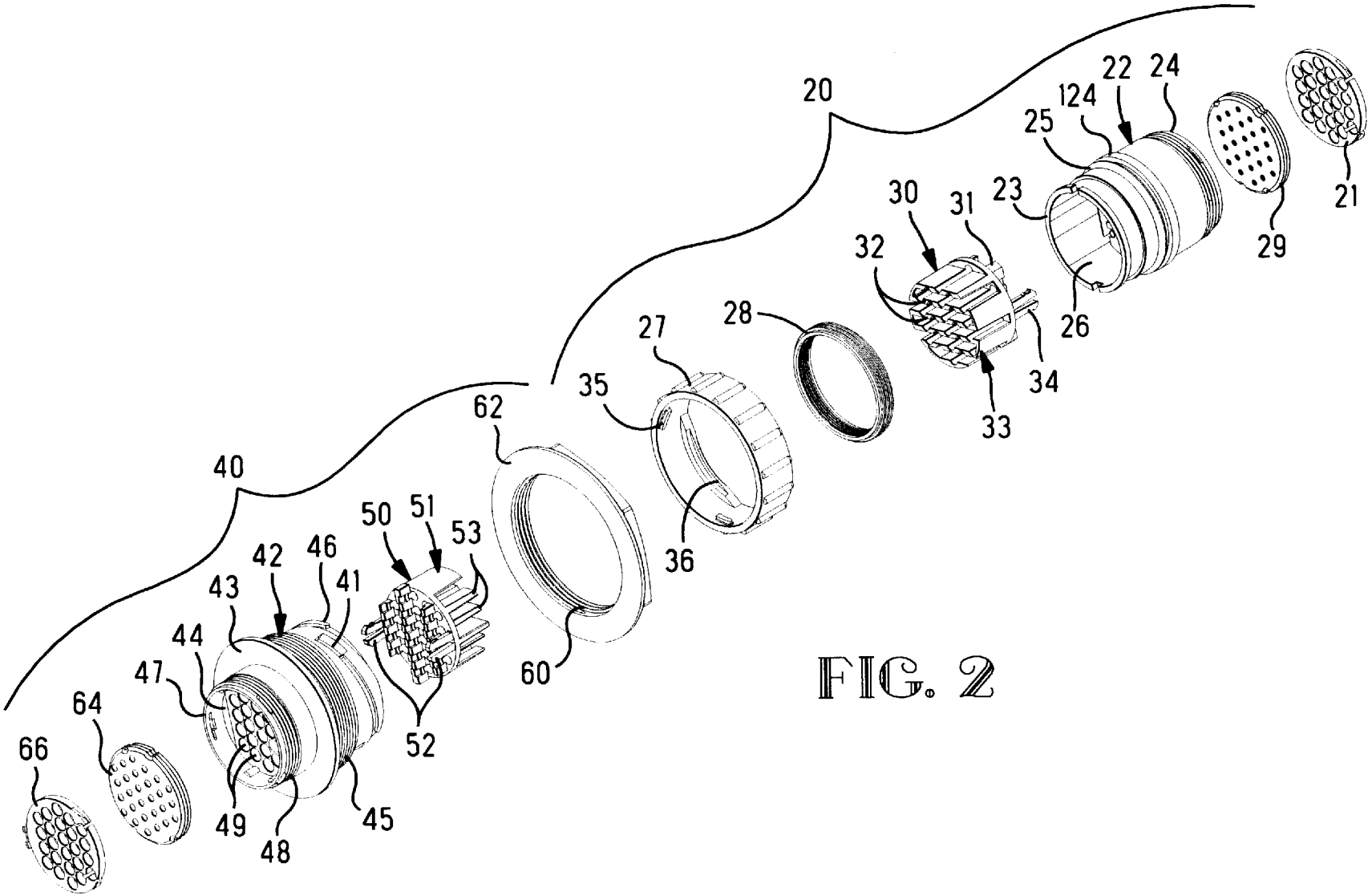
FIG. 2 shows an isometric exploded view of the connection system of FIG. 1.

The invention will first be described generally with reference to FIGS. 1 and 2. The electrical connector arrangement (10) is shown here in a mated condition and consists of a plug connector (20) which is made matable with a receptacle connector (40). The plug connector (20) has an insulative plug housing (22) with a wire receiving end (24) which receives a retention plate (21). The retention plate (21) has a plurality of openings (37) for receiving terminated wires into cavities of the plug housing (22). A coupling ring (27) surrounds the plug housing (22) at it's mating end (23). The coupling ring (27) is free to rotate about the plug housing (22) and has a threading portion (35) on its interior surface for receiving the receptacle connector (40).

The receptacle connector (40) is profiled to be mounted to a panel and features a receptacle housing (42) having a wire receiving end (47) which is similar to that of the plug housing (22). A shoulder (43) is formed around the receptacle housing (42). A jam nut (62) is threadable to the receptacle housing (42) and will engage shoulder (43), and would secure the panel's cutout periphery between itself and shoulder (43).

Figure 3:
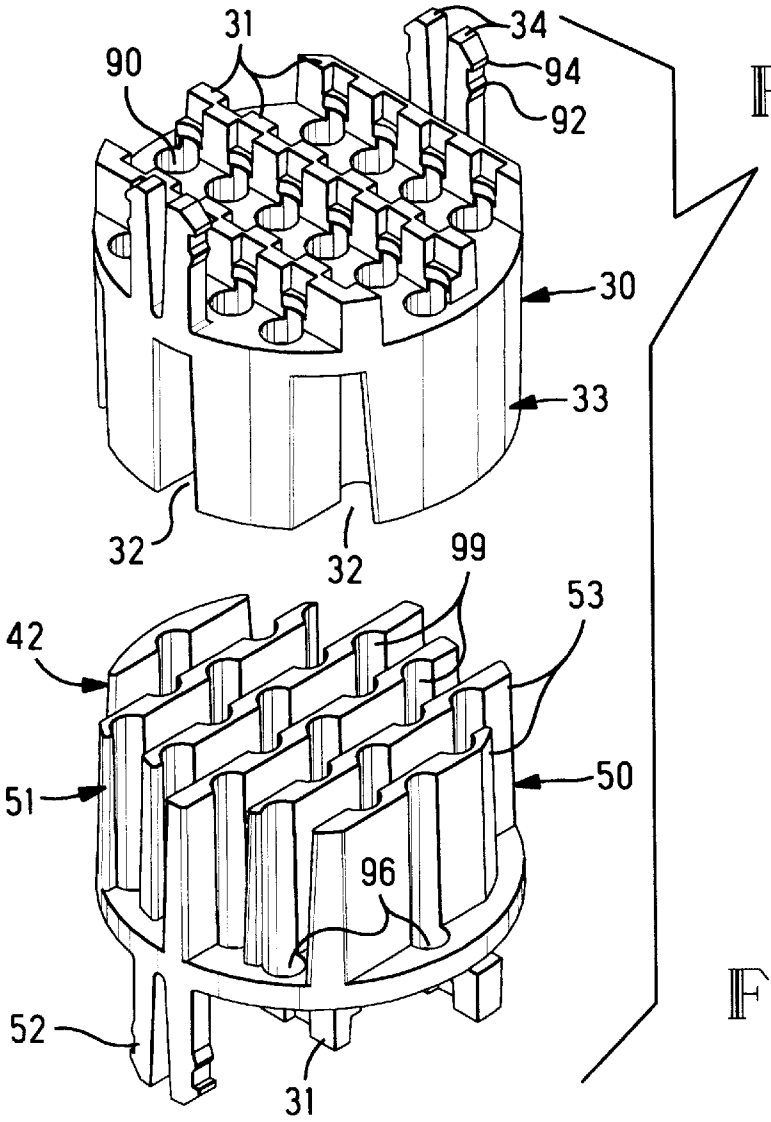
FIG. 3 shows an isometric view of the secondary lock members as viewed from the plug side.
Figure 4:
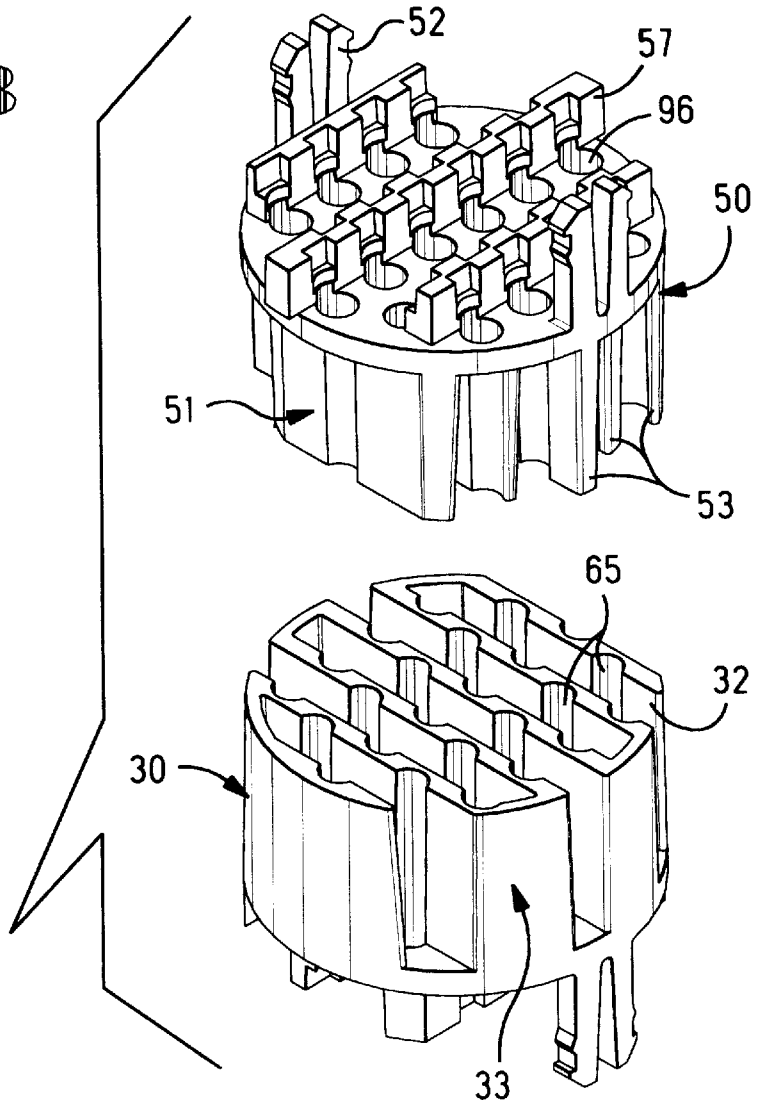
FIG. 4 shows an isometric view of the secondary lock members as viewed from the receptacle side.

Each of the major components will now be described in greater detail with reference to FIGS. 2 to 4. Referring first to FIG. 2, the plug connector (20) features insulative plug housing (22) which is generally cylindrically shaped and has a wire receiving end (24) and a mating end (23). A terminal receiving area (26) is located inside the insulative plug housing (22). The terminal receiving area has a plurality of terminal receiving passageways which extend therethrough. These passageways are the same as those in the receptacle connector (40) and will be described in greater detail below. A shoulder (124) is disposed around the outside of the insulative plug housing (22) near its center and a ring locking shoulder (25) is disposed adjacent to shoulder (124). At the wire receiving end (24), a wire entry seal (29) is received inside a large recess in the connector. A retention plate (21) locks into the plug housing (22) at the wire receiving end (24) and serves to retain the wire entry seal (29). A mating seal (28) is profiled to fit around plug housing (22) forwardly of ring locking shoulder (25) proximate the mating end (23). A coupling ring (27) features a locking projection (36) which fits in between the ring locking shoulder (25) and the shoulder (124). Threading projections (35) are also located along the interior surface of the coupling ring (27).

A secondary lock member (30) is profiled to fit inside the terminal receiving area (26) and features a series of locking projections (31) on a first side along with latch arms (34) extending adjacent to the locking projections (31). A shroud section (33) extends opposite the locking projections (31). Keying recesses (32) are formed in the shroud section, extending into the mating face; one end of each recess (32) is seen to be closed off, serving as a key, while a corresponding end of the associated wall-like keying projection (53) of secondary lock member (50) of the mating connector is foreshortened to serve as a keyway. Optionally, the wall-like projections and corresponding recesses could be defined directly on the housings, if no secondary lock member would be otherwise required. The secondary lock member (30) will be described in greater detail below.

The receptacle connector (40) includes an insulative receptacle housing (42) having a shoulder (43), a threaded portion (45) disposed adjacent to shoulder (43) and a second threaded portion (41) around the receptacle housing (42) near the mating end (46). A similar wire entry seal (64) and retention plate (66) are disposed inside a terminal receiving area (44) near the wire receiving end (47). A jam nut (62) is profiled to have a threaded section (60) on its interior surface which is received by the threads (45) on the receptacle housing (42). A complementary secondary lock member (50) features similar latching arms (52), a plurality of keying projections or walls (53) on a shroud portion (51), and locking projections (57) for the terminals similarly to locking projections 31 of FIGS. 2 and 3. The terminal receiving area is designed similar to that of the plug (20) and features a plurality of terminal receiving passageways (49) extending from the wire receiving end (47) toward the mating end (46). The inside of these passageways can be best seen in FIG. 5. The passageways (49) are profiled to each have a latching finger extending from a wall toward the mating end (46). The latching fingers (55) are resilient to allow terminal insertion and latch behind a shoulder (102) of each terminal (100).

Each of the secondary lock members (30,50) will now be described in greater detail with reference to FIGS. 3 and 4. Referring first to FIG. 3, the secondary lock member (30) which is received in the plug housing (22) features a plurality of locking projections (31) each extending adjacent a terminal receiving passageway (90). The terminal receiving passageways (90) are arranged in rows to be aligned with the passageways in the housing.

Each locking projection (31) is also adjacent another locking projection (31) which faces a terminal receiving passageway (90) on an opposite row. A plurality of latch arms (34) extend in the same direction as the locking projections (31). The latch arms (34) are spaced apart from each other and are flexible towards each other. Each latch arm (34) has a pre-latch projection (94) on its outer surface and a lock projection (92) also on the outer surface spaced apart from the prelatch projection (94). A shroud section (33) extends opposite the locking projections (31) and features and plurality of keying recesses (32) which extend perpendicular to the terminal receiving passageway rows. Referring to FIG. 4, it can be seen that the keying recesses (32) have a plurality of curved surfaces (65) complementary to contact sections of the terminals, that provide clearance for mating with mating contact sections of the mating connector.

The secondary lock member (50) in FIG. 4 which is receivable in the receptacle housing (42) will now be described in greater detail. The latch arms (52) are the same as those on the other secondary lock member (30). Also, locking projections (57) are similar to locking projections (31) described earlier and also extend along respective rows of terminal receiving passageways (96). The shroud section (51), however, is designed to be complementary to the shroud section (33) and features a plurality of walls (53) extending opposite the locking projections (31) and generally perpendicular to the rows of terminal receiving passageways (96).

Figure 5:
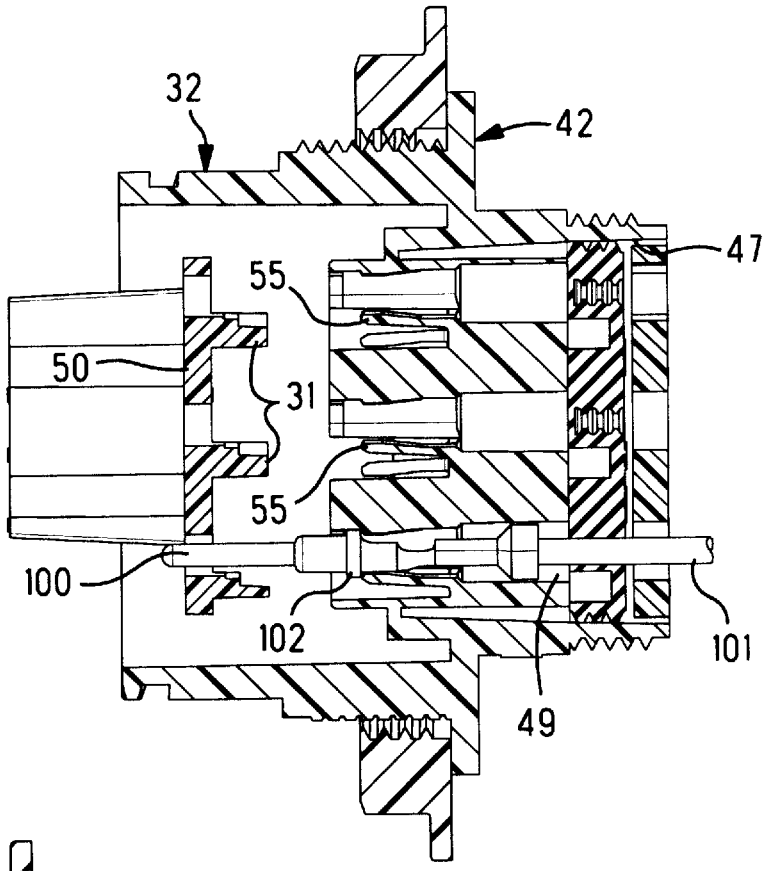
FIG. 5 shows a cross-sectional view of the receptacle connector having the secondary lock removed.

Assembly of the terminals and the secondary lock members (30,50) will now be described with reference to FIGS. 5 to 7. It should be understood from the following description that while either the plug (20) or the receptacle (40) are being described, assembly of the secondary lock members (30,50) to their respective housings (22,42) is accomplished by the same assembly process.

Figure 7:
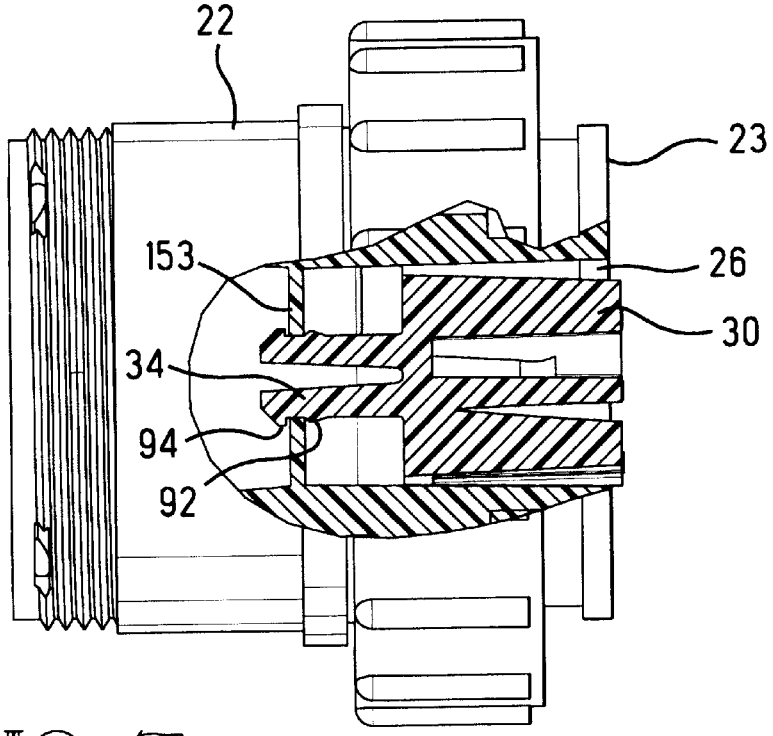
FIG. 7 shows a side view of the plug connector having a cut-away section to show the secondary lock member.

Referring first to FIG. 7, it can be seen that the secondary lock member (30) is inserted into the terminal receiving area (26) and is shown here in a pre-latch position. This position is defined by the latch arms (34) being secured behind a wall (153) of the plug housing (22) such that the pre-latch projection (94) is inserted beyond the wall (153) but the locking projection (92) has not yet passed the wall (153). When in the pre-latch position, each of the locking projections (31) are positioned to allow free movement of latching fingers (55) (FIG. 5). Wires (101) having terminals (100) on their ends are then inserted from a wire receiving end (47)

into the terminal receiving passageways (49) of the housing (42). Each terminal (100) has a shoulder (102) which engages a latching finger (55) extending into the terminal receiving passageway (49).

Figure 6:
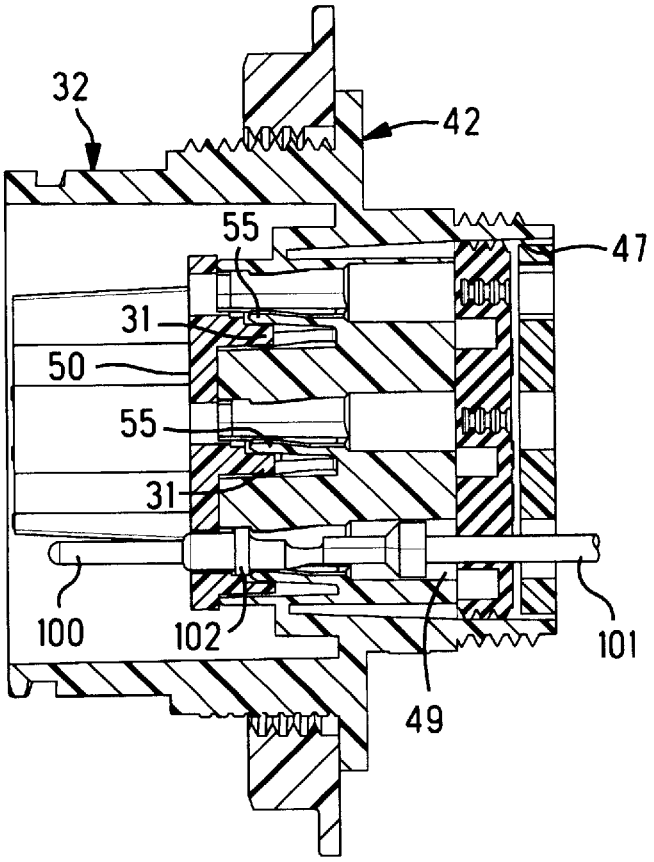
FIG. 6 shows a cross-sectional view of the receptacle connector having the secondary lock inserted.
Figure 8:
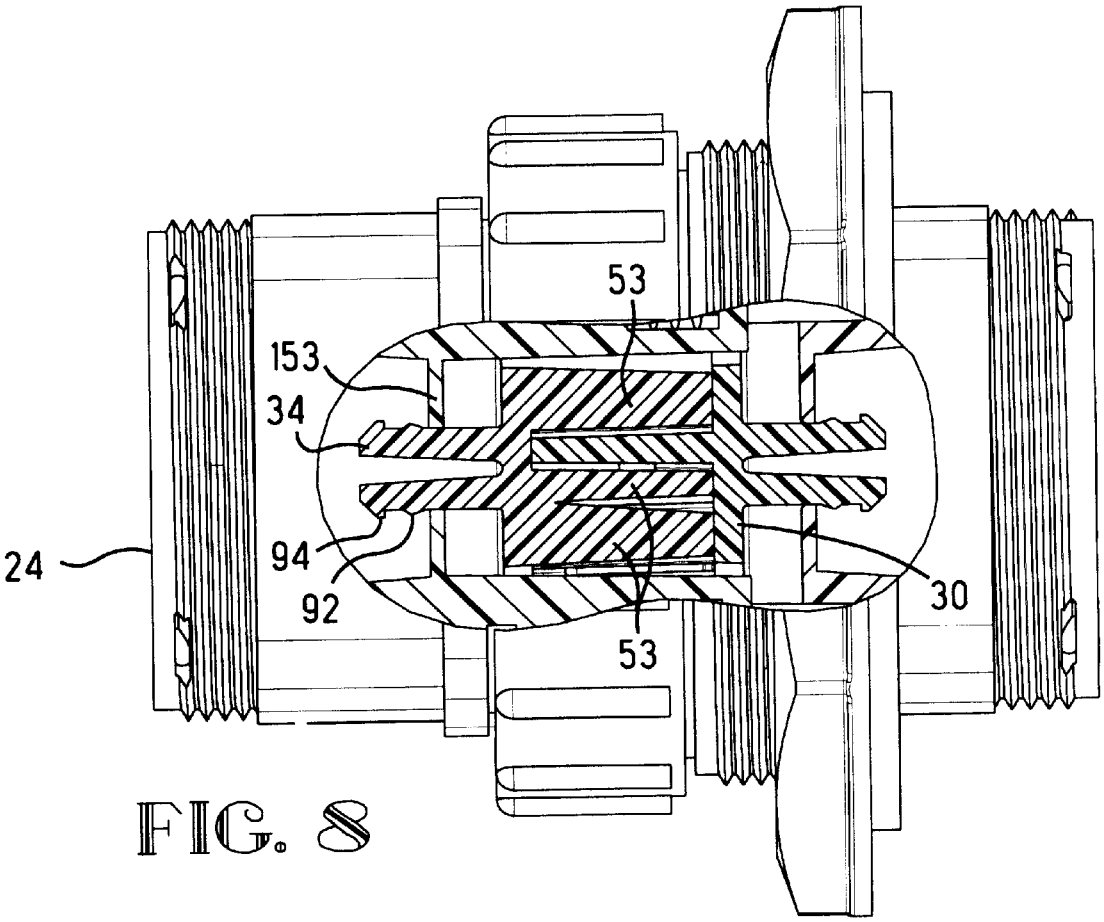
FIG. 8 shows a side view of the plug and receptacle connectors having a cut-away section showing both secondary lock members in a mated condition.

The secondary lock member (30,50) may then be urged into a locked position as shown in FIGS. 6 and 8. In this locked position, the locking projection (92) on the latch arm (34) is urged beyond the wall (153). As shown in FIGS. 6 and 8, this will result in each locking projection (31) engaging a side of a respective latching finger (55) which is opposite the terminal (100). This will prevent the latch finger (55) from disengaging the shoulder (102) of the terminal (100). Thus, secondary locking is achieved. Referring to FIG. 8, the keying features of the terminal shroud sections (33,51) can be seen in a mated condition. Here it can be seen how the walls (53) fit into the keying recesses (32) of the secondary lock member (30). It should be noted here that various keying arrangements can be achieved utilizing the concepts presented here. For example, the keying projections (53) disposed on the secondary lock (50) inside the receptacle (40), can be located in secondary lock (30) of the plug (20) instead, and correspondingly, keying recesses (32) located in secondary lock (50) of receptacle (40). Other keying arrangements can be achieved by slightly changing the shape of the walls (53) and the complementary keying recesses (32).

While the foregoing has been provided with reference to the embodiment, various changes within the sprit of the invention will be apparent to those reasonably skilled in the art. For example, contact pins can be loaded in either the plug (20) or the receptacle (40). Similarly as was discussed above with reference to the secondary lock members (30, 50), most of the other features shown can be interchanged between the plug (20) and the receptacle (40). Thus, the invention should be considered as limited only by the scope of the claims.

Preferably, walls (53) include curved surfaces (99) defining channels that are complementary to contact sections of the terminals (100) of the connector and are sufficiently large to permit mating of the contacts of the two connectors, and extend forwardly beyond leading ends of the terminals (FIG. 6). Similarly, keying recesses (32) are defined by walls that also have curved surfaces (65) complementary to contact sections of terminals of the connector and extend forwardly beyond leading ends of the terminals. By this, the secondary lock members define shroud sections (33,51) that protrude beyond the closely spaced terminals and thus prevent incidental contact therewith when the connectors are unmated, thus eliminating electrical shock hazard.

The advantage of the present invention is that the secondary lock members (30,50) provide secondary locking for a high density connection arrangement along with keying features to ensure the mating of appropriate plugs and receptacles. In addition, the secondary lock members (30, 50) provide shroud sections (33,51) to cover the terminals and prevent the risk of electrical shock when the connectors are in an unmated condition.

The wall-like keying projections and keying recesses of the shrouds of the connectors could optionally be defined on the housings directly, providing shock protection with respect to the contacts, in the event that no secondary lock member is required with the connectors.

I claim:

1. An electrical connector assembly comprising:

first and second mating connectors, the first connector having a first insulative housing defining a first mating face, the second connector having a second insulative housing defining a second mating face, both of the connectors having a plurality of terminal receiving passageways and respective contacts disposed inside respective ones of the passageways, the contacts of each connector including contact sections exposed along the respective mating faces for mating with complementary contact sections of contacts of the other connector;

the first connector including a plurality of spaced-apart walls extending forwardly of the first mating face, and the second connector including a plurality of recesses in the second mating face complementary to the walls;

the walls extending adjacent to the contact sections of the contacts of the first connector and extending beyond leading ends thereof, and the contacts of the second connector being recessed in the recesses from the second mating face, and the walls being received in the recesses during mating of the first and second mating connectors, whereby the first and second mating faces define protective shrouds surrounding the contact sections.

2. The connector assembly of claim 1 wherein the recesses of the second mating face are closed off, and the associated walls of the first connector are foreshortened, whereby the first and second mating faces are keyed.

3. The connector assembly of claim 1 wherein the first and second mating faces are defined by insulative secondary members positioned adjacent forward ends of the insulative housings.

* * * * *